US005943961A

United States Patent [19]

Rudibaugh et al.

[11] Patent Number: 5,943,961

[45] Date of Patent: Aug. 31, 1999

[54] SPLIT WEDGE BOLSTER POCKET INSERT

[75] Inventors: John W. Rudibaugh, West Chester; Charles L. Van Auken, Dillsburg, both of Pa.

[73] Assignee: Pennsy Corporation, Westchester, Pa.

[21] Appl. No.: 08/943,831

[22] Filed: Oct. 3, 1997

[51] Int. Cl.[6] ..... B61F 3/00

[52] U.S. Cl. ..... 105/198.2; 105/198.4; 105/198.5

[58] Field of Search ..... 105/198.2, 198.4, 105/198.5, 197.05

[56] References Cited

U.S. PATENT DOCUMENTS 2,129,408 9/1938 Davidson ..... 105/198.5

4,244,298 1/1981 Hawthorne et al. .

*Primary Examiner*—Mark T. Le
*Assistant Examiner*—Dan Yeagley
*Attorney, Agent, or Firm*—Banner & Witcoff, Ltd.

[57] ABSTRACT

In a freight car truck assembly, an insert for converting a substantially flat, inclined, bolster pocket back wall into a pair of inclined surfaces for biasing a pair of split wedges laterally outwardly against side walls of the bolster pocket to create a space between the pair of split wedges. The insert is provided with a centrally located fin which projects into the space between the split wedges and engages against a side frame friction surface to control the location of the insert in the bolster pocket through frictional interference as the fin rubs against the friction surface. The insert can be loosely mounted in the bolster pocket without any need for welding the insert in place.

18 Claims, 5 Drawing Sheets

FIG. 4
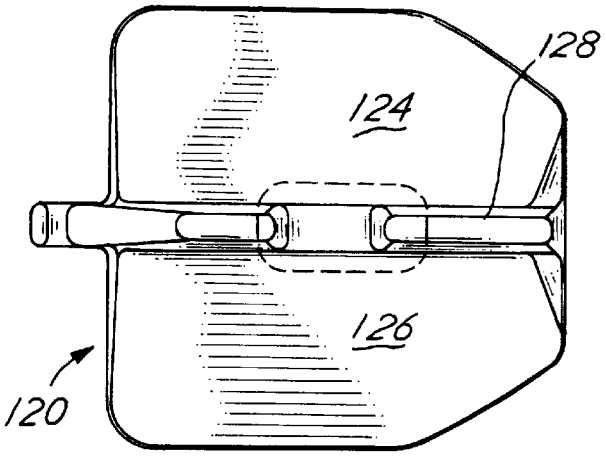
FIG. 5
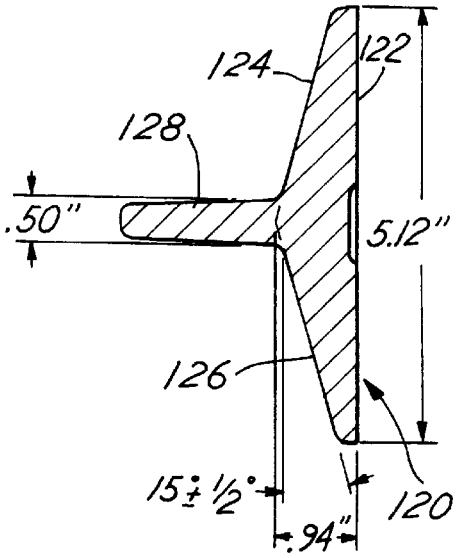
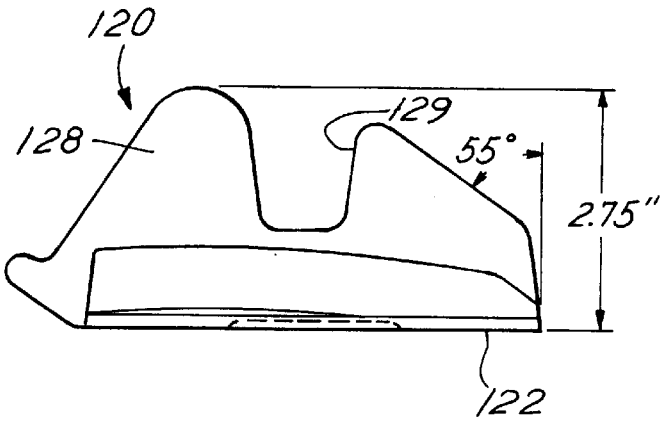
FIG. 6

SPLIT WEDGE BOLSTER POCKET INSERT

BACKGROUND OF THE INVENTION

The present invention relates to a known freight car truck assembly including a pair of laterally spaced side frames which are each carried by a pair of wheelsets, the side frames being spanned by a transversely extending bolster. Each side frame has an opening which receives a corresponding end of the bolster, and the ends of the bolster are supported by spring groups housed within the respective side frame openings.

In addition to the foregoing known structure, it is also known to provide a pair of friction wedges for supporting each end of the bolster, one wedge being positioned in a corresponding bolster pocket formed in longitudinally spaced sides of each bolster end. Such friction wedges are supported by wedge springs which urge each friction wedge upwardly in the bolster pocket between the bolster and a wear surface which comprises a side frame column.

As the bolster end moves vertically, each friction wedge slides against the corresponding side frame column to generate damping forces. Since the spring force loading a friction wedge is a function of the spring group travel or vertical motion of the bolster, the spring force is greater when the car is loaded than when the car is empty. Thus, the damping force varies with the car weight.

U.S. Pat. No. 4,244,298, issued Jan. 13, 1981, serves to illustrate the known prior art over which the present invention is an improvement. In the '298 patent, FIG. 1 shows a pair of laterally spaced side frames 10 together with a bolster 14 which extends between the side frames with the bolster ends received in side frame openings 16 as shown in FIG. 2.

FIG. 2 of the '298 patent shows a bolster end 14 supported on spring groups 24 contained within the side frame opening 16 and supported by the side frame. FIG. 2 further shows a friction wedge 26 contained within a bolster pocket so as to bear against a sloping wall of the bolster pocket and also against a wear surface on a side frame column 22. A wedge spring 28 urges the wedge 26 upwardly between the bolster and the side frame column. A similar wedge and related structure is provided at the longitudinally opposite side of the bolster end in an opposed bolster pocket (not shown in FIG. 2).

FIG. 3 of the '298 patent, which uses different reference numbers from FIGS. 1 and 2, affords an enlarged view of an end of a bolster 40 having opposed bolster pockets 42 at longitudinally opposite sides of the bolster end, which pockets receive corresponding wedges 52. Each wedge 52 has a friction surface 56 which frictionally engages the opposed column end surface 50 of the side frame column 44. In addition, the wedge has a surface 48 sloping at an angle of approximately 35 degrees relative to opposed column end surface 50. The sloping wedge surface 48 frictionally engages the opposed sloping surface 54 of the bolster pocket 42 formed in bolster 40. The pocket 42 accommodates the wedge 52 which is urged upwardly between the side frame column 44 and the bolster surface 54 by the wedge spring 60.

Reference is now made to FIGS. 19 and 20 of the '298 patent. FIG. 19 shows opposed pockets 42 of the bolster 40 with a wedge 52 positioned in each pocket. Each pocket 42 is shown as having a conventional, flat bolster pocket surface 54 which is engaged by a similar surface 48 on the wedge 52. The surfaces 48 and 54 are sloping surfaces, but they are flat.

A different embodiment is shown in FIG. 20 where each wedge 52 is replaced by a pair of spaced wedges 52*a* and 52*b*, the sloping back wall 48 of the bolster pocket comprises a pair of sloping surfaces, and the inner ends of the pair of wedges have similar sloping surfaces. Thus, in FIG. 20, the bottom of the bolster pocket, in addition to sloping as shown in FIG. 3, is made to slope from each sidewall 46 of the bolster pocket toward the center of the pocket and toward the opening into the pocket. The sloping sections 64 of the bolster pocket are flat across the width thereof and merge along the length thereof to form a rectilinear crown 65 disposed midway between the opposed sidewalls of the bolster pocket.

In the FIG. 20 arrangement, the wedge is formed in two separate sections 52*a* and 52*b* disposed side-by-side in the pocket 42*a* in slightly spaced relation to one another. The sloping surfaces of the wedge sections are beveled, and the beveled surfaces 62 are disposed in full-face engagement with the opposed sloping sections 64 of the pocket, while the remote sides of the wedge sections 58*a* are in full-face engagement respectively with the opposed sides 46 of the pocket. The foregoing arrangement permits the wedge spring 60 to urge both sections of the wedge against the sideframe column 44 due to the sloping surfaces as shown in FIG. 3. Simultaneously, the wedge sections are separately urged respectively against the bolster pocket sidewalls 46 due to the sloping surfaces shown at 62 and 64 in FIG. 20.

Still referring to the sloping surfaces 64 of the bolster pocket as shown in FIG. 20, such surfaces are commonly formed by casting them as part of the bolster pocket. However, another known option is to provide an insert which has the two approximately 15-degree slopes, and weld that insert into a bolster pocket of the type shown in FIG. 19 of the aforementioned '298 patent. Thus, where a bolster pocket has a flat bottom as shown in FIG. 19 of the '298 patent, one may convert the structure to the type shown in FIG. 20 of the patent by welding an insert in the pocket to create those 15-degree slopes, and then the split wedge members as shown at 52*a* and 52*b* in FIG. 20 may be used in place of the single wedges shown in FIG. 19. Such inserts are known in the art and are usually forged to create the desired sloping surfaces.

Reference is made to FIGS. 1–3 which show a known type of insert for converting a bolster pocket of the type shown in FIG. 19 of the aforementioned '298 patent to a pocket of the type shown in FIG. 20. FIG. 2 shows the insert 10 having a flat surface 12 on one side and a pair of sloping surfaces 14 and 16 on the opposite side. The sloping surfaces meet in the center to form a line 18. FIG. 3 shows how the merged surfaces at line 18 have a curved shape.

The use of split wedges as shown in FIG. 20 of the '298 patent have advantages over the single wedges shown in FIG. 19 of the patent. However, where the sloping shape has not been cast into the bolster pocket, the known forged inserts must be welded into the pocket to convert from the FIG. 19 design to the FIG. 20 design. One disadvantage of such inserts is that the welding operation involves an added expense.

The foregoing welding operation is a significant procedure because the forged insert must be welded around the sides and top. The main object of the present invention is to provide an insert which is modified in a manner which permits it to be used for the same purpose as known inserts, but without any need for welding the insert in place. Thus, the added expense of the welding operation is eliminated.

The foregoing and other objects and advantages of the invention will be apparent from the following description of a preferred embodiment thereof, taken in conjunction with the accompanying drawings.

DESCRIPTION OF THE DRAWINGS

FIG. 4 is a plan view of an improved insert constructed in accordance with the present invention;

FIG. 5 is a transverse section of the insert of FIG. 4;

FIG. 6 is an elevational view of the insert of FIG. 4;

Figure 1:
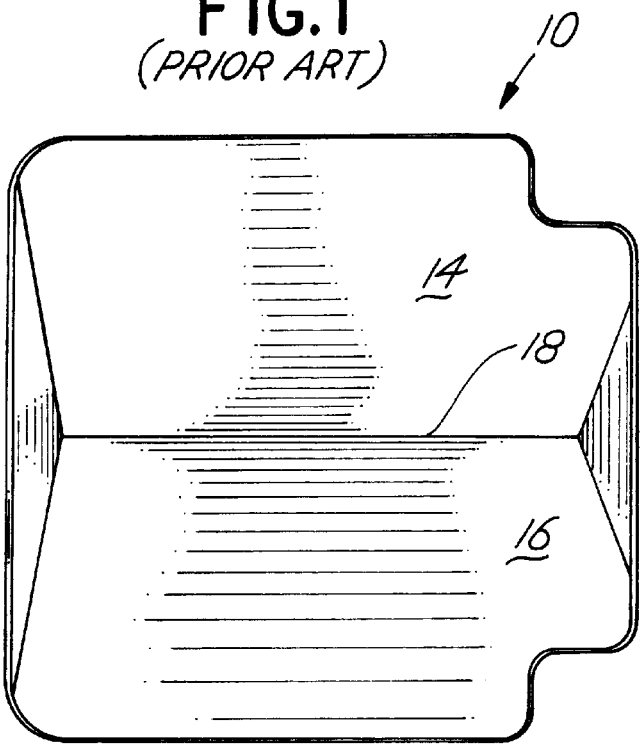
FIG. 1 (PRIOR ART)
FIG. 1 is a plan view of an insert having sloping surfaces as known in the prior art.

Now, in order to acquaint those skilled in the art with the manner of making and using our invention, we shall describe, in conjunction with the accompanying drawings, a preferred embodiment of the invention.

DETAILED DESCRIPTION OF THE INVENTION

Reference is now made to FIGS. 4–6 which show an improved insert constructed in accordance with the present invention. To avoid confusion, reference numbers higher than "100" will be used to refer to the preferred embodiments; numbers below "100" refer to the '298 patent. FIG. 5 shows the improved insert 120 having a flat surface 122 on one side and a pair of sloped surfaces 124 and 126 on the opposite side. The sloping surfaces merge centrally, but in the area where the surfaces 124 and 126 merge, there is provided a projecting fin 128. In the particular embodiment illustrated, the thickness of the fin 128 at its lower end is approximately 0.50 inch, and as shown in FIG. 6, its maximum height measured from the flat surface 122 is 2.75 inches.

As best shown in FIG. 6, the fin 128 has a substantial recess 129 which is to accommodate passage of a temporary locking pin as will be described more fully later herein. As will also be more fully described later, the insert 120 can be inserted in the usual position in a bolster pocket, as has been done previously with the known insert shown in FIGS. 1–3, except no welding is required. The improved insert 120 is designed so it can be mounted in the bolster pocket with no need to fix the insert to the pocket. The thickness of the fin 128 is designed so it can project into the space between a pair of split wedges, such as the space shown between split wedges 52*a* and 52*b* in FIG. 20 of the aforementioned '298 patent.

Figure 7:
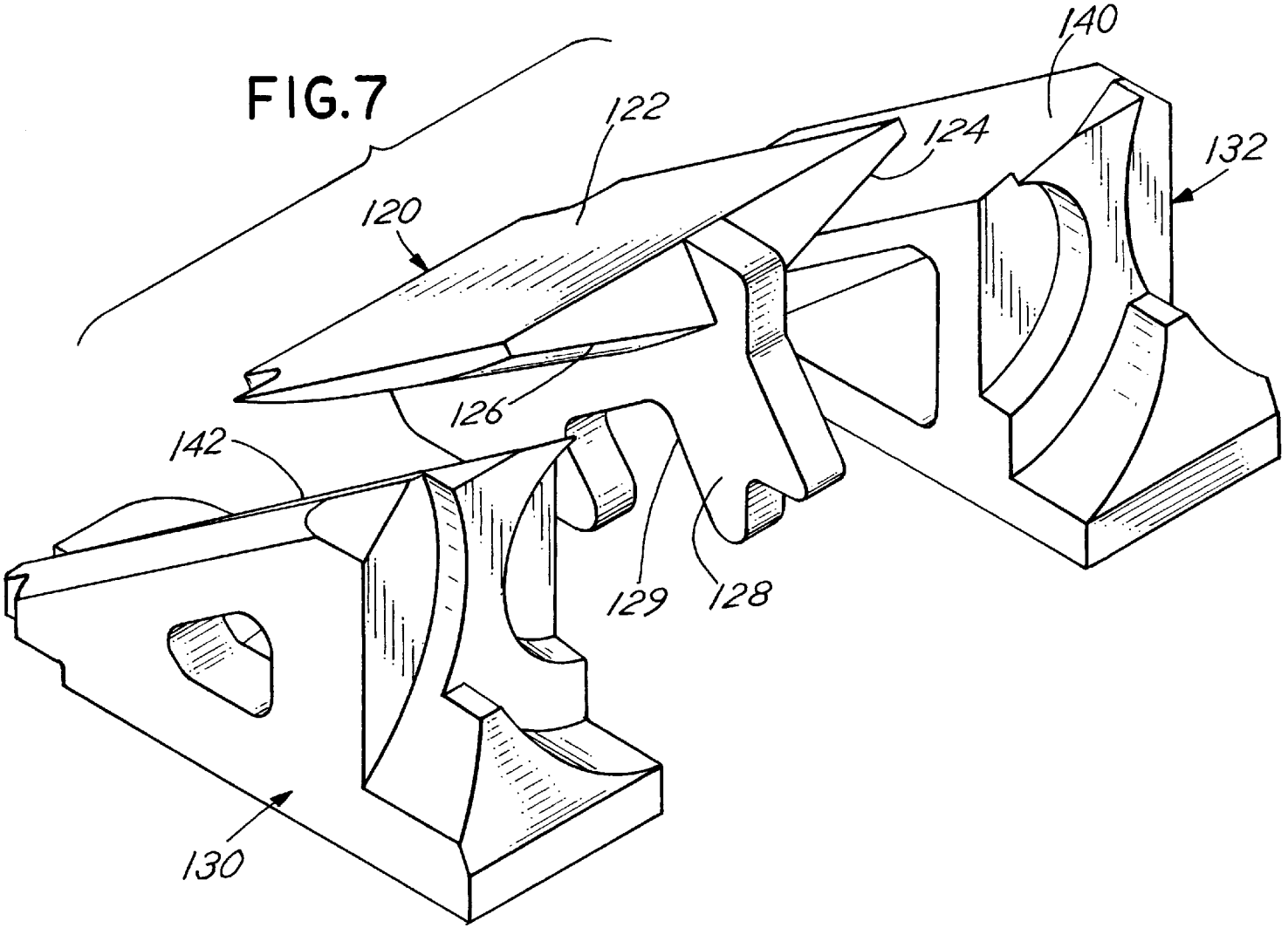
FIG. 7 is an isometric, exploded view showing a pair of known split wedges in conjunction with an insert constructed in accordance with the present invention.

FIG. 7 is an isometric showing of the improved insert 120 in conjunction with a pair of split wedges 130 and 132. The split wedges 130 and 132 will not be described in detail because they are known in the art. FIG. 7 does not show precisely the same structure for the fin 128 as shown in FIGS. 4–6, which show the preferred design. However, FIG. 7 serves the purpose of providing an isometric illustration of how the improved insert 120 is assembled loosely in a bolster pocket together with a pair of split wedges, with the fin 128 extending into the space which normally occurs between the split wedges in the assembled position. Inclined surfaces 140 and 142 on the wedges 130 and 132 engage against the corresponding sloped surfaces 124 and 126 on the insert 120 so the inserts are biased laterally outwardly to create a space between them in the same manner as illustrated in FIG. 20 of the aforementioned '298 patent.

Figure 9:
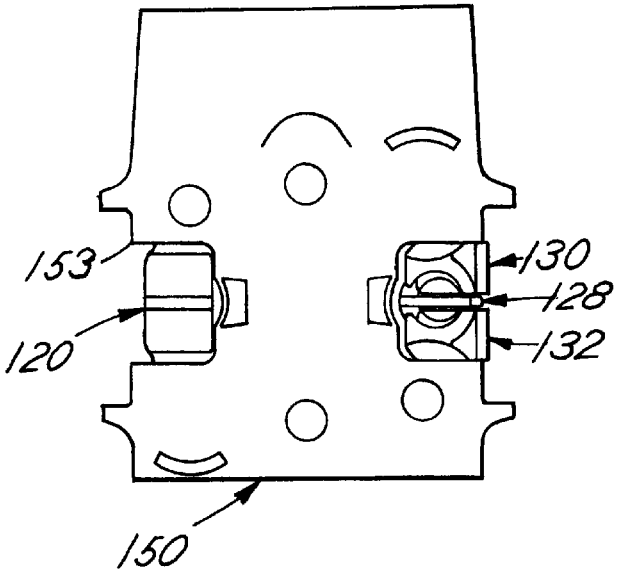
FIG. 9 is a reduced, bottom view showing the improved insert in conjunction with known components as in FIG. 8.
Figure 10:
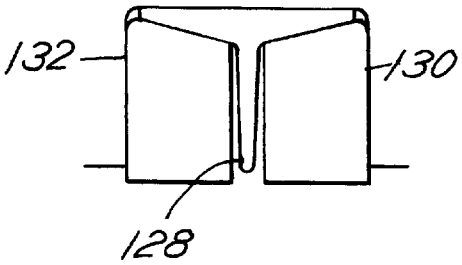
FIG. 10 is a diagrammatic view showing how a projecting fin on the improved insert fits between a pair of split wedges in the assembled position.
Figure 8:
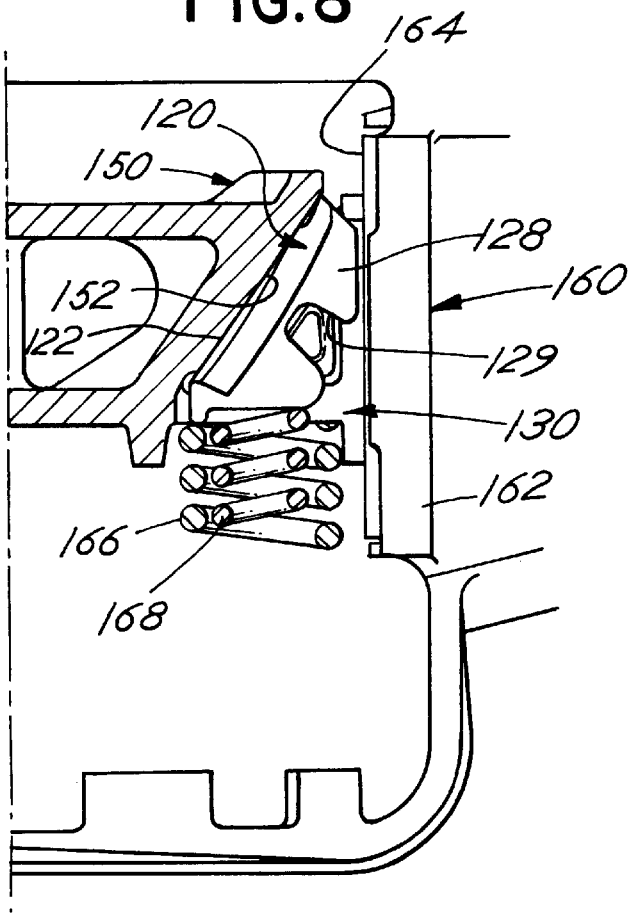
FIG. 8 is a fragmentary, elevational view, partly in section, showing the improved insert used with a known bolster pocket and known split wedges, there being shown springs which support both the insert and the split wedges.
Figure 11:
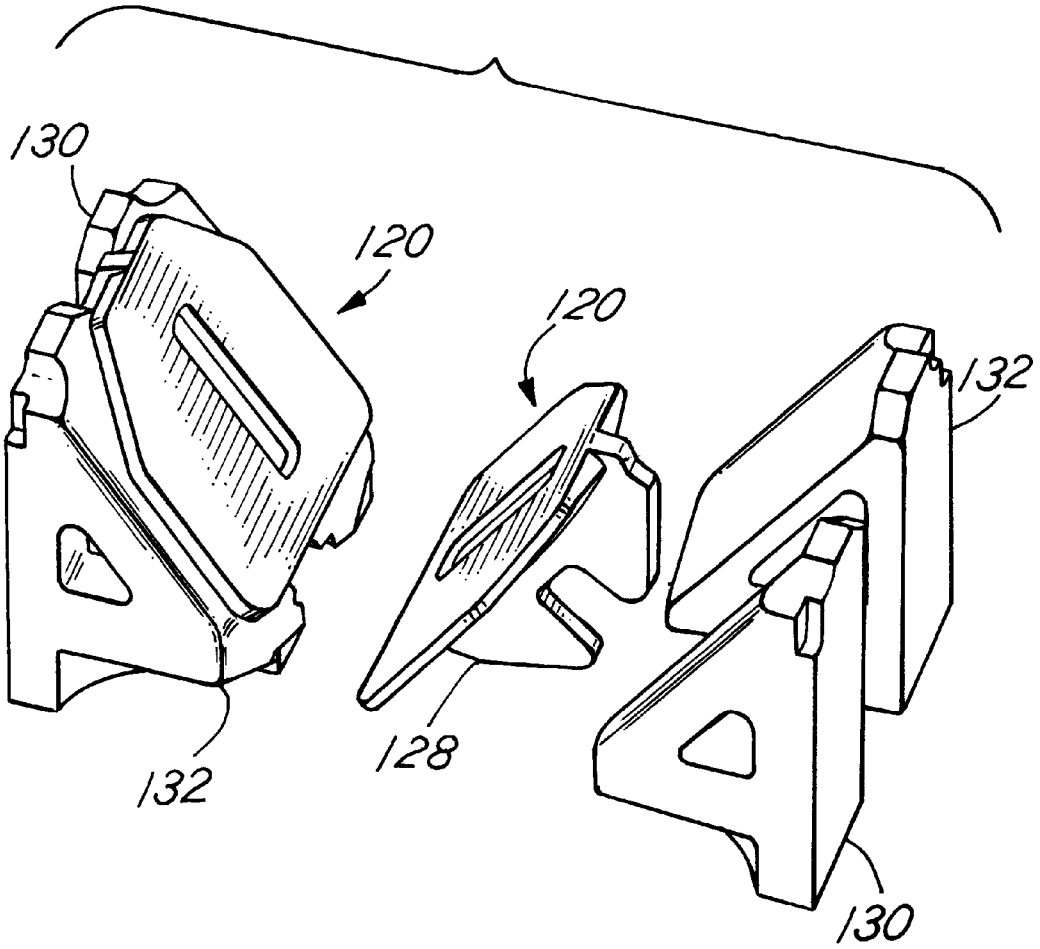
FIG. 11 is a detail, assembly view showing on the left side an assembly of a pair of split wedges and an improved insert, and showing on the right side the same components prior to assembly.

Reference is now made to FIGS. 8–10. FIG. 8 shows a fragmentary view, partly in section, illustrating one side of the end of a bolster 150, including a bolster pocket having an inclined back wall 152. The inclined back wall 152 of the bolster pocket is flat, as in the case of the bolster pocket wall surface shown at 54 in FIG. 19 of the '298 patent. The insert 120 is positioned in the pocket with its flat wall 122 engaged against the bolster pocket wall 152. However, the insert is not welded or otherwise attached to the bolster pocket.

One of a pair of split wedges is shown at 130, 132, and it has the fin 128 which is positioned between the pair of split wedges, the wedge 130 partially hidden by the fin 128 being the only one shown in FIG. 8. A side frame is shown at 160 having a side frame column 162 comparable to the column shown at 44 in FIG. 20 of the '298 patent. The inner side of the column 162 comprises a wear surface 164. FIG. 8 further shows an outer spring 66 and an inner spring 168. The outer spring 166 is regularly used, but the inner spring 168 is optional.

As previously described, and as best shown in FIG. 7, the two split wedges 130, 132 have inclined surfaces which bear against the inclined surfaces 124 and 126 of the insert 120 to bias the split wedges laterally outwardly against the sidewalls of the bolster pocket as illustrated in FIG. 20 of the '298 patent. Thus, as viewed in FIG. 8, the wedge shown at 130 is biased away from the viewer, and the opposed wedge (not shown) is biased in the opposite direction, leaving a space between the wedges which is partially occupied by the insert fin 128.

FIG. 9 is a reduced, bottom view showing the end of the bolster 150, a pair of opposed side pockets 153 in the bolster end, and a forged or cast insert 120 positioned in each pocket. The left side of FIG. 9 shows how the insert 120 appears from the underside, and the right side is broken away to show the two wedges 130, 132 and the projecting fin 128 which extends into a space between the two split wedges.

FIG. 10 is a diagrammatic view providing a further showing of how the projecting fin 128 extends into the space created between the split wedges 130, 132. There is no intent to provide a press fit between the fin 128 and the split wedges 130, 132, but the spacing is relatively close as shown in the drawings.

Referring again to FIG. 8, the insert fin 128 is biased upwardly by the outer spring 166 (and also the inner spring 168 if that is used), and the upper end of the fin is engaged against the side frame column wear surface 164. Thus, the insert is wedged between the wear surface 164 and the inclined back wall 152 of the bolster pocket so it cannot move upwardly.

Figure 2:
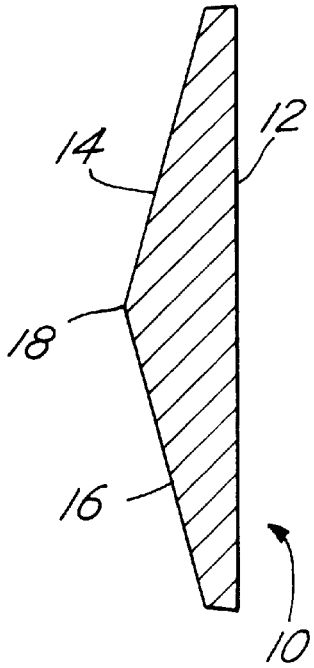
FIG. 2 (PRIOR ART)
FIG. 2 is a transverse section of the known insert of FIG. 1.
Figure 3:
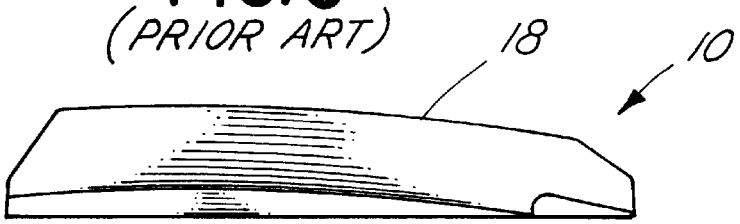
FIG. 3 (PRIOR ART)
FIG. 3 is an elevational view of the insert of FIG. 1.

The operation of the insert 120 and the split wedges 130, 132 is essentially the same as when the prior art welded insert of FIGS. 1–3 is used. As noted above, the outer spring 166 engages against the bottom of the fin 128 (and the inner spring if used does the same). The outer spring 166 may engage the bottom of the fin 128 at one location only, and the remainder of the upper end of the spring is engaged against the split wedges 130, 132 to bias them upwardly.

When the prior art insert of FIGS. 1–3 was welded to the bolster pocket, there could not, of course, be any relative movement between them. When the improved insert of FIGS. 4–6 is used, which is not welded or otherwise attached to the bolster pocket, there can be relative movement between the insert and the bolster pocket, but such movement is extremely limited so as to be of no significance.

When the insert and split wedges are assembled together with the springs in a bolster pocket, it is known to temporarily fix the split wedges in position while the spring or springs are being inserted. In order to do that, a pin is customarily inserted through the split wedges to hold them in the desired position until the springs are inserted. Thus the openings shown in the split wedges are to accommodate such a pin, and the recess shown at 129 in FIG. 6 is also provided to accommodate such a temporary locking pin. The recess 129 in the fin 128 could be in the form of a hole, but it is believed somewhat easier to produce the fin having a recess of the type shown.

The improved insert of the present invention is simple, but the advantage is very significant because the elimination of the welding operation reduces the cost of manufacture and makes it more competitive with other designs, such as the designs shown in FIGS. 19 and 20 of the '298 patent. The improved insert 120 is essentially the same as the known insert, except for the addition of fin 128. The fin 128 should be formed in the center of the insert where the sloping surfaces 124 and 126 merge as shown in FIG. 5. Such a fin location is necessary so it can fit in the space between the split wedges.

As for the width of fin 128, one knows the space created between the split wedges when they are biased laterally outwardly against the side walls of the bolster pocket, and that is the space a designer must work with. As noted above, a press fit is not desired, but the thickness of the fin should approach the width of the space between the split wedges. Note, however, that it is not the fin 128 which keeps the split wedges biased laterally outwardly. By way of example only, if the distance or space between the split wedges is 0.75 inch, one might then provide the fin 128 with a maximum thickness of 0.50 inch, thereby leaving a space of one-eighth inch between each side of the fin and the adjacent split wedge.

As for the other dimensions of fin 128, FIG. 8 shows that the upper portion of the fin must engage against the side frame wear plate 164, so the dimension of that portion of the fin above recess 129 is dictated so it will engage the wear plate. As for the lower end of fin 128, beneath recess 129, as shown in FIG. 8, it may be designed to cooperate with the upper ends of springs 166 and 168.

Summarizing, the improved insert 120 is provided with a projecting fin 128 which eliminates the need for welding the insert into a bolster pocket, and it accomplishes that advantage by providing a centrally located protrusion on the insert which is designed to secure or control the location of the insert in the bolster pocket through frictional interference as the fin rubs against the side frame wear plate 164. In that manner, the fin 128 controls downward movement of the insert which was previously controlled by welding the insert to the bolster pocket.

Of course, it is significant that the fin 128 rests on one or two sets of springs 166, 168 as previously described. In both the prior art embodiments and with the new invention, the split wedges sit on springs, such as springs 166, 168, and such wedges also engage against the wear plate 164 of the side frame column. In the prior art, no fin was provided on the insert, so of course it was only the split wedges which sat on the top of the springs and engaged against wear plate 164.

What is claimed is:

1. For use in a freight car truck having a pair of laterally spaced wheeled side frame members each having a bolster opening and including a pair of longitudinally spaced column members with opposed friction surfaces defining the length of said opening, a bolster member spanning said side frame members and having opposite end portions respectively projecting into said bolster openings, longitudinally opposite side surface areas of each said bolster end portion respectively opposed to said friction surfaces and a bolster pocket formed in each of said side surface areas of said bolster, each said bolster pocket being defined by an inclined, substantially flat back wall and a pair of laterally spaced pocket side walls, the improvement comprising:

an insert for mounting loosely in said pocket together with a pair of split wedges, said insert having a substantially flat wall on one side for engaging said inclined, flat back wall of said bolster pocket, and a pair of tapered walls on an opposite side of said insert, said tapered walls substantially merging in a central area of maximum thickness of said insert, said pair of tapered walls serving to cooperate with said pair of split wedges to bias said wedges laterally outwardly against respective ones of said pocket side walls to create a space between said split wedges, and said insert having a fin which projects longitudinally out from said opposite side of said insert at said central area of maximum thickness, said fin having a thickness less than the said space between said split wedges, and said insert being positionable in said pocket such that said fin extends into said space and projects an amount sufficient to engage against said friction surface, and means for biasing said insert upwardly in said pocket to wedge said insert between said inclined back wall of said bolster pocket and said friction surface of said side frame column whereby said fin controls the location of said insert in said bolster pocket through frictional interference as said fin rubs against said friction surface of said side frame column without need to weld said insert to said bolster pocket, where said fin has a recess formed therein to accommodate a temporary locking pin.

2. An insert as defined in claim 1 where said means for biasing said insert upwardly in said pocket comprises spring means.

3. An insert as defined in claim 2 where said spring means engages against said fin and also against said split wedges to bias said insert and said split wedges upwardly to wedge the same in said pocket.

4. An insert as defined in claim 1 where said recess communicates with an outer surface of said fin to facilitate manufacture of said insert.

5. An insert as defined in claim 1 where said insert is forged.

6. An insert as defined in claim 1 where said fin is provided with a lower end portion to engage an upper end of a spring to bias said insert upwardly in said pocket.

7. An insert as defined in claim 1 where said space between said split wedges is approximately 0.75 inch and said thickness of said fin is approximately 0.50 inch to provide clearance between each side of said fin and an adjacent split wedge of approximately one-eighth inch.

8. An insert as defined in claim 1 where the maximum height of said fin measured from said substantially flat wall is approximately 2.75 inches to provide for optimum engagement of said fin against said friction surface on said side frame column.

9. An insert in connection with split friction wedges in a truck assembly, the truck assembly including a side frame member having a bolster opening and a bolster extending into the opening, the bolster including a bolster pocket having an inclined substantially flat back wall, the insert comprising:

a substantially flat first surface for frictionally engaging the back wall, and second and third substantially flat surfaces opposite the first surface, each extending at an angle to the first surface and engaging respective one of the split friction wedges; and a fin projecting from the tapered walls in a direction opposite the first surface and adapted to occupy a space between the split friction wedges.

10. The invention of claim 9, wherein the second and third surfaces extend at substantially the same angle relative to the first surface.

11. The invention of claim 9, wherein the fin is adapted to receive a biasing force from a spring, the fin extending longitudinally in a direction that is substantially parallel to the direction of the biasing force.

12. The invention of claim 9, wherein the fin is provided with a recess for receiving a locking pin.

13. The invention of claim 9, wherein the second and third surfaces merge centrally, the fin projecting from the area where the second and third surfaces merge.

14. A freight car truck assembly comprising:

a side frame member having a bolster opening;

a bolster extending into the opening, the bolster including a bolster pocket having an inclined substantially flat back wall;

a pair of friction wedges disposed within the bolster pocket;

an insert comprising a substantially flat first surface for frictionally engaging the back wall and forming second and third substantially flat surfaces opposite the first surface and extending at an angle thereto, said second and third flat surfaces engaging respective ones of the friction wedges; and a fin projecting from the tapered walls in a direction opposite the first surface and adapted to occupy a space between the friction wedges.

15. The assembly of claim 14, wherein the second and third surfaces extend at substantially the same angle relative to the first surface.

16. The assembly of claim 14, wherein the fin is adapted to receive a biasing force from a spring, the fin extending longitudinally in a direction that is substantially parallel to the direction of the biasing force.

17. The assembly of claim 14, wherein the fin is provided with a recess for receiving a locking pin.

18. The assembly of claim 14, wherein the second and third surfaces merge centrally, the fin projecting from the area where the second and third surfaces merge.

* * * * *